US007357285B2

(12) United States Patent
Namekawa et al.

(10) Patent No.: US 7,357,285 B2
(45) Date of Patent: Apr. 15, 2008

(54) ADHESIVE-TAPE CUTTER

(75) Inventors: Hidejiro Namekawa, Saitama (JP); Mitsuaki Imazeki, 2914, Inouchi, Narutonmaehi, Sanbu-gun, Chiba (JP) 289-1304

(73) Assignee: Mitsuaki Imazeki, Chiba (JP)

( * ) Notice: Subject to any disclaimer, the term of this patent is extended or adjusted under 35 U.S.C. 154(b) by 229 days.

(21) Appl. No.: 11/267,731

(22) Filed: Nov. 4, 2005

(65) Prior Publication Data

US 2006/0201984 A1 Sep. 14, 2006

(51) Int. Cl.
*B26F 3/02* (2006.01)

(52) U.S. Cl. ..... 225/6; 225/90; 156/463

(58) Field of Classification Search ..... 225/6, 225/90; 156/463, 465; 83/649
See application file for complete search history.

(56) References Cited

U.S. PATENT DOCUMENTS

| | | | | |
|---|---|---|---|---|
| 4,576,674 | A * | 3/1986 | Le Tarte | 156/463 |
| 5,792,310 | A | 8/1998 | Thompson et al. | |
| 6,502,616 | B1 * | 1/2003 | Row | 156/463 |
| 2002/0121169 | A1 * | 9/2002 | LeMoine | 83/38 |

FOREIGN PATENT DOCUMENTS

| | | |
|---|---|---|
| FR | 2173453 | 11/1973 |
| JP | 06-59356 | 8/1994 |
| JP | 09315665 | 9/1997 |
| JP | 2001-199620 | 7/2001 |
| JP | 2003-11081 | 1/2003 |
| JP | 2003054826 | 2/2003 |
| JP | 2003095521 | 4/2003 |
| JP | 2003118926 | 4/2003 |
| JP | 2003206067 | 7/2003 |
| WO | 8304380 | 12/1983 |

* cited by examiner

*Primary Examiner*—Kenneth E. Peterson
*Assistant Examiner*—Phong Nguyen
(74) *Attorney, Agent, or Firm*—Clements Bernard Miller; Christopher L. Bernard

(57) ABSTRACT

The adhesive tape cutter comprises a body bracket with a support that rotatably supports an adhesive-tape roll and a cutting section to cut adhesive tape pulled out from the adhesive-tape roll supported. A path to pull out the adhesive tape from the support to the cutting section is a double-portion forming section that comprises adhesive face-side members disposed on a side faced by an adhesive face of the adhesive tape and non-adhesive face-side members disposed on a side faced by a non-adhesive face thereof that folds a longitudinal side edge of a predetermined width of the adhesive tape in a direction that the adhesive face is facing to stick when the adhesive tape is inserted between both the member groups and pulled out pressing against the members. A tape cover is provided outside the support and pivotably coupled to the body bracket.

1 Claim, 7 Drawing Sheets

ADHESIVE-TAPE CUTTER

CROSS-REFERENCE TO RELATED APPLICATIONS

The present application claims priority from Japanese Patent Application No. 2003-127863 filed on May 6, 2003, which is herein incorporated by reference.

TECHNICAL FIELD

The present invention relates to a tape cutter for broad adhesive-tape rolls which are often used in packaging and the like and particularly to a handy tape cutter which folds back a longitudinal side edge of adhesive tape pulled out from an adhesive-tape roll so that opposite adhesive faces stick together to form a non-adhesive portion for facilitating the removal of the tape after use.

BACKGROUND ART

Adhesive tape is a thin film-like strip base made of cloth, cellophane, craft paper, rubber, polyvinyl chloride, or the like which has its one surface coated with an adhesive made mainly from rubber or synthetic resin, and usually this adhesive tape is rolled into an adhesive-tape roll, which is available in the market. Such adhesive tapes are used in various sticking applications and in particular, broad adhesive tape of about 50 mm in width is often used in packaging such as closing cardboard boxes.

When using such broad adhesive tape in packaging or the like, the adhesive tape is pulled out from an adhesive-tape roll and cut to have a desired length and is stuck to an object. A tape cutter for facilitating this task is disclosed in, for example, Japanese Patent Laid-Open Publication No. 2001-146356 wherein an adhesive tape can be stuck only by holding the tape cutter in the hand and pressing the adhesive face of adhesive tape pulled out at the leading end of the tape cutter against an object.

This adhesive tape holder has a configuration where a tape guide to guide pulled-out adhesive tape is formed on one end of its body into which adhesive tape wound into a roll is loaded, where the tape guide has a tape cutting blade provided on its leading end and a surface to guide the pulled-out adhesive tape shaped to have a profile whose inside is raised above its edges, where a tape holding section having a plurality of protrusions on its one surface is disposed across the surface to guide the adhesive tape, and where arms of a cover that has a plurality of protrusions on its one surface and covers both sides sandwich opposite sides of the tape holding section and the cover pivots about main shafts that go through the arms respectively and are fixed to both the sides of the tape holding section.

In most cases, broad adhesive tape used in packaging or the like is used to temporarily join, and after use, removed or cut. Since the strip base of the adhesive tape is thin and has its one entire surface coated with an adhesive, it is fairly troublesome to remove the adhesive tape sticking to an object from it. That is, when removing an adhesive tape whose entire adhesive face is sticking to an object, you need to turn up the outer edge of the adhesive tape with your nail or the like so as to form a picking-off margin, and take hold of the picking-off margin with the tips of your fingers and pick the adhesive tape off. The turning up of a picking-off margin causes much trouble.

DISCLOSURE OF INVENTION

The present invention can solve the above and other problems, and an object thereof is to provide an adhesive tape cutter that can easily form a non-adhesive portion along the longitudinal direction as a picking-off portion to facilitate removal of the adhesive tape after stuck by folding a side edge of the adhesive tape back to stick and also easily stick a tape to an object by being operated by one hand, while forming the non-adhesive portion.

In order to achieve the above and other objects, according to an embodiment of this invention, there is provided an adhesive tape cutter comprising a body bracket provided at its one end with a support that rotatably supports an adhesive-tape roll and at the other end with a cutting section to cut adhesive tape pulled out from the adhesive-tape roll supported by the support. Provided in a path to pull out the adhesive tape through from the support to the cutting section in the body bracket is a double-portion forming section that comprises adhesive face-side members disposed on a side faced by an adhesive face of the adhesive tape and non-adhesive face-side members disposed on a side faced by a non-adhesive face thereof and that, after the adhesive tape is inserted through between the adhesive face-side members and the non-adhesive face-side members, folds at least one side edge of a predetermined width of the adhesive tape in a direction that the adhesive face is facing to form a double portion as a non-adhesive portion along its longitudinal direction when the adhesive tape is pulled out, and a tape cover is provided outside the support and pivotably coupled to the body bracket so as to cover at least part of the adhesive-tape roll supported by the support, to contact an outer circumferential surface of the adhesive-tape roll and form part of a grip.

By using the adhesive tape cutter, while the non-adhesive portion, the double portion, is being easily, continuously formed at the side of the adhesive tape along the longitudinal direction, the adhesive tape can be stuck. Thereafter, when opened, the adhesive tape can be easily picked off holding the double portion as a picking-off portion.

Here, the double-portion forming section may comprise a bending roller as one of the adhesive face-side members that contacts the adhesive face of the adhesive tape except the side edge of the predetermined width to be bent; a bending guide block as one of the non-adhesive face-side members that is placed opposite an end face of the bending roller and contacts and presses against the non-adhesive face of the side edge of the adhesive tape, not contacting the bending roller, to sandwich the side edge between the end face of the bending roller and itself and bend the side edge of the predetermined width in the direction that the adhesive face is facing; a folding guide block as one of the adhesive face-side members that has a guide portion contacting and pressing against the non-adhesive face of the bent side edge to bend the side edge to be at an acute angle and that is placed on the side faced by the adhesive face of the adhesive tape; and a press roller that contacts and presses against the non-adhesive face of the adhesive tape having the side edge folded to stick together opposite adhesive faces of the folded adhesive tape.

Other tasks of this application and ways to achieve the tasks will be made clear with referring to the description of the embodiments of the present invention and the accompanying drawings.

BEST MODE FOR CARRYING OUT THE INVENTION

Preferred embodiments of an adhesive tape cutter according to the present invention will be described below in detail with reference to the accompanying drawings.

FIRST EMBODIMENT

Figure 1:
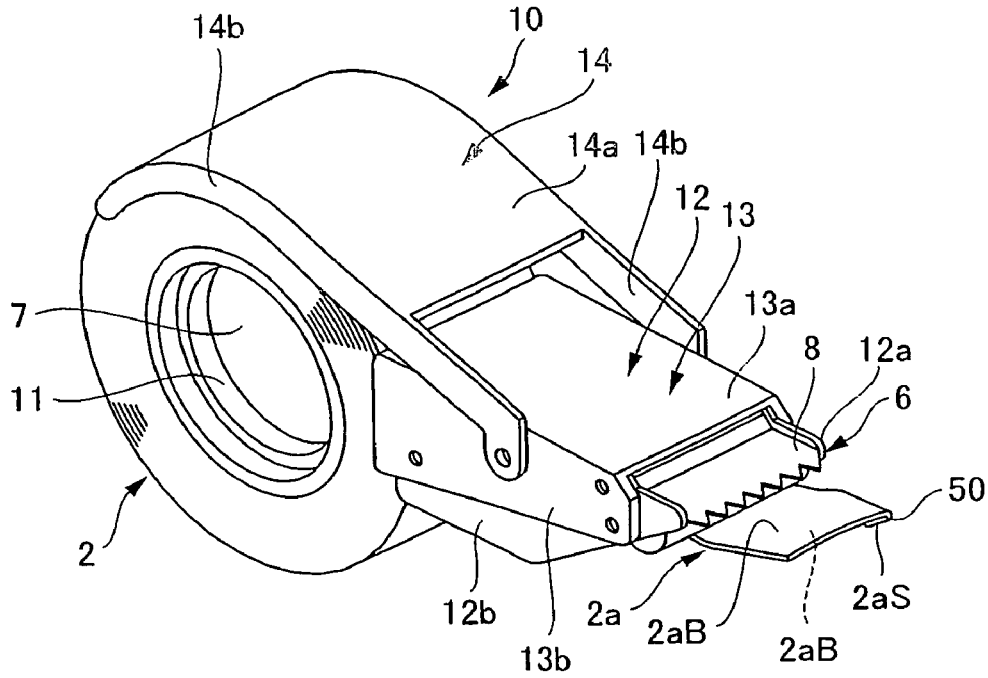
FIG. 1 is a perspective view illustrating an adhesive tape cutter according to a first embodiment of the present invention.
Figure 2:
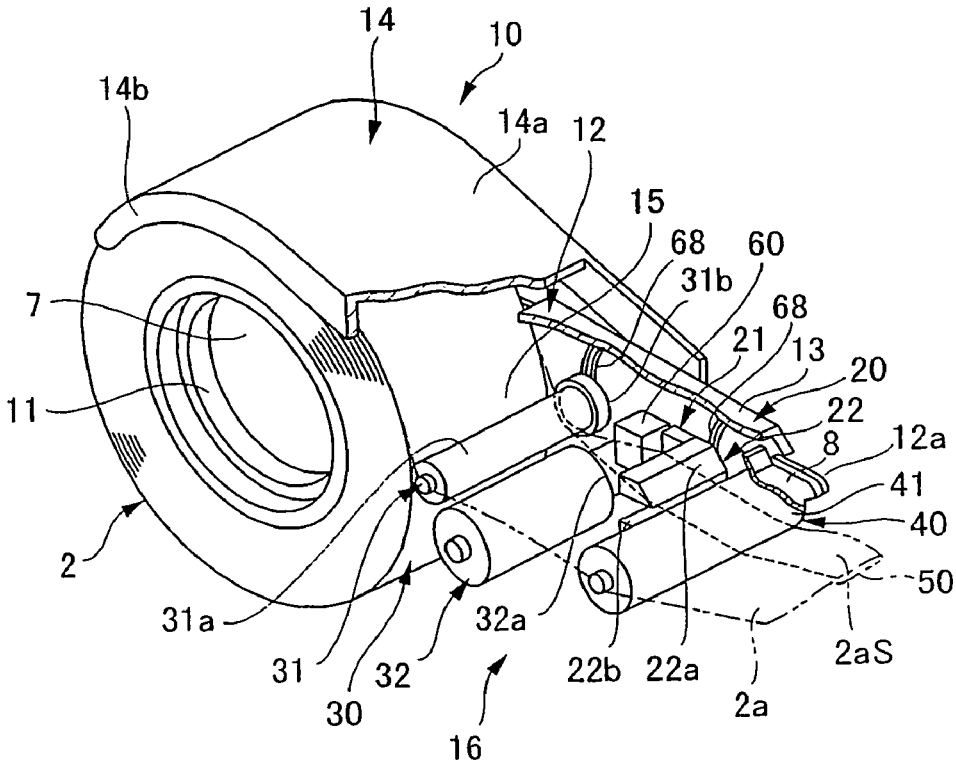
FIG. 2 is a partially cut-away perspective view illustrating the configuration of the tape cutter of FIG. 1.
Figure 3:
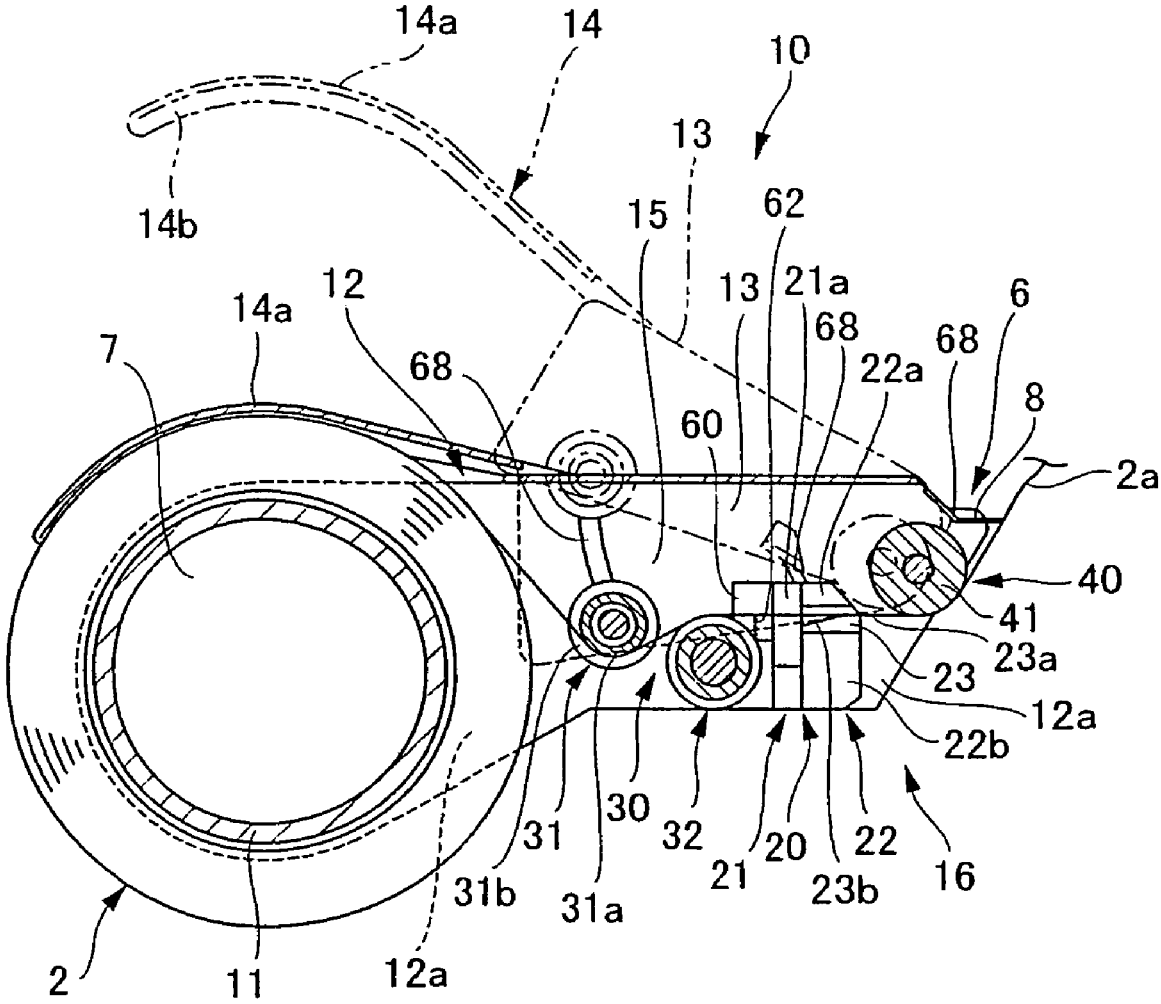
FIG. 3 is a side view illustrating the configuration of the tape cutter of FIG. 1.
Figure 4A:
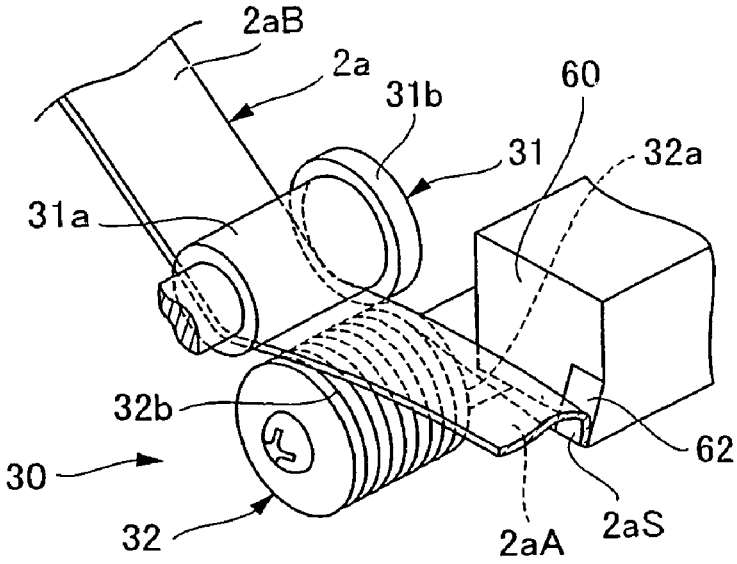
FIGS. 4A and 4B are detailed perspective views of a bending mechanism and folding mechanism of a double-portion forming section shown in FIG. 2 respectively.
Figure 4B:
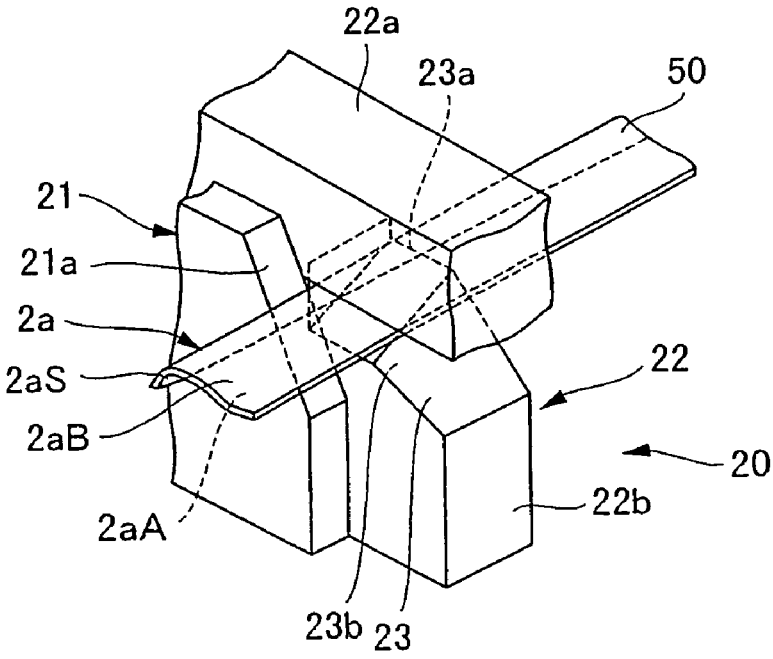

FIG. 1 is a perspective view illustrating a first embodiment of the adhesive tape cutter according to the present invention; FIG. 2 is a partially cut-away perspective view illustrating the configuration of the adhesive tape cutter of FIG. 1; FIG. 3 is a partial sectional view illustrating the configuration of the adhesive tape cutter of FIG. 1; and FIGS. 4A, 4B are perspective views illustrating in detail a bending mechanism and folding mechanism of a double-portion forming section of FIG. 2 respectively.

As shown in these figures, an adhesive tape cutter 10 is used to pull out a desired length of adhesive tape 2*a* from an adhesive-tape roll 2 into which long adhesive tape 2*a* of about 50 mm in width having its one face, an adhesive face 2*a*A, coated with an adhesive is wound like a roll and to cut it off. When packaging various objects into boxes made of cardboard or the like, the adhesive tape cutter 10 is used to close the lids of the box with pieces of the adhesive tape 2*a* and has such a shape that a worker holding it in one hand can stick a piece of the adhesive tape 2*a* to an object and cut it off.

This tape cutter 10 has a body bracket 12 that comprises a tape housing section 7 and a cutting section 6. The body bracket 12 further comprises a movable bracket 13 fitting on the outside of the cutting section 6 and to which a tap cover 14 is pivotably coupled.

The tape housing section 7 of the body bracket 12 is constituted by a hollow cylinder-like tape holder 11 formed integrally with one end of a support plate 12*a* (on its left side in FIGS. 1 to 3), and when the inner circumferential surface of the adhesive-tape roll 2 fits on the outer circumferential surface of the tape holder 11, the adhesive-tape roll 2 is rotatably supported by the tape holder 11. Furthermore, a circular opening 12*c* corresponding to the inner diameter of the tape holder 11 is formed through the support plate 12*a*, and a finger can be inserted into the circular opening 12*c* and the cylinder-like tape holder 11. Provided on the other side from the tape holder 11, i.e., on the right side end in the Figures of the support plate 12*a* is a cutter blade 8 supported at both ends by the support plate 12*a* and a side plate 12*b*. The cutter blade 8 forms part of the cutting section 6 to cut the adhesive tape 2*a* pulled out from the adhesive-tape roll 2.

The movable bracket 13 comprises a top plate 13*a* and a pair of side plates 13*b* on opposite sides of the top plate 13*a* and is an open/close member having a cross-section shaped like a squared U. The bracket 13 fits on the outside of the cutting section 6, covering this section and is coupled in an openable/closable manner to the leading ends of the support plate 12*a* and side plate 12*b* of the body bracket 12 via pivot pins 13*c*.

Moreover, part of the circumferential surface of the adhesive-tape roll 2 mounted on the tape holder 11 is covered by the tap cover 14. The tap cover 14 has a curved cover plate 14*a* and is pivotably coupled to the movable bracket 13 and, as the outer diameter of the adhesive-tape roll 2 varies, moves following the variation in the outer size so as to contact the circumferential surface of the adhesive-tape roll 2 all the time. By pressing the thumb of one hand and the palm part at its base against the cover plate 14*a* and inserting another finger into the cylinder of the tape holder 11 and griping, it is possible to grip the tape cutter 10 with one hand. The tape holder 11 and the tap cover 14 form a grip of the tape cutter 10.

Furthermore, rib-like fastening portions 14*b* protrude down along opposite sides of the cover plate 14*a* and partially cover opposite sides of the adhesive-tape roll 2 so as to prevent the adhesive-tape roll 2 from falling off from the tape holder 11. Also, the fastening portions 14*b* extend like stays further than one end of the cover plate 14*a*, and the leading ends thereof are pivotably coupled to the side plates 13*b* of the movable bracket 13 by pins 14*c*.

A tape inserting chamber 15 surrounded by the support plate 12*a* and side plate 12*b* of the body bracket 12 and the movable bracket 13 is formed in between the tape housing section 7 and the cutter blade 8. Disposed in the tape inserting chamber 15 is a double-portion forming section 16 which folds back a longitudinal side edge 2*a*S of the adhesive tape 2*a* so that opposite adhesive faces stick together to form a continuous non-adhesive portion at the side of the adhesive tape 2*a*.

The tape inserting chamber 15 is communicated at one end to the tape housing section 7 and at the other end to the cutting section 6 provided with the cutter blade 8. And the adhesive tape 2*a* pulled out from the adhesive-tape roll 2 held by the tape holder 11 extends from the tape housing section 7 through the tape inserting chamber 15 to the cutting section 6.

The double-portion forming section 16 disposed in the tape inserting chamber 15 comprises a bending mechanism 30 that bends one longitudinal side edge 2*a*S of the pulled-out adhesive tape 2*a* in the direction that the adhesive face is facing (backward) or downward to be at an angle of about 90°; a folding mechanism 20 that further bends the bent side edge 2*a*S to be at about 180° so that the adhesive faces are facing each other; and a sticking section 40 that sticks the opposite adhesive faces together.

The bending mechanism 30, as shown in FIGS. 2, 3, 4A, comprises a positioning roller 31 as a positioning section, a bending roller 32 as a bending section, and a bending guide block 60.

The positioning roller 31 is provided in between the tape holder 11 as a tape support and the bending roller 32, to position the adhesive tape 2*a* pulled out from the adhesive-tape roll 2 in such a position as to be fed to the bending roller 32, and comprises a roller body 31*a* and a flange 31*b* provided on an end of the roller body 31*a* and is rotatably, pivotably coupled to the side plates 13*b* of the movable bracket 13. The non-adhesive face 2*a*B of the adhesive tape 2*a* pulled out from the adhesive-tape roll 2 contacts and presses against the roller body 31, and the flange 31*b* contacts one side end of the adhesive tape 2*a*. The positioning roller 31 positions the adhesive tape 2*a* pulled out from the adhesive-tape roll 2 in terms of its height and position in the width direction and guides the tape to the bending roller 32.

The bending roller 32 is situated in between the folding mechanism 20 and the positioning roller 31 and rotatably, pivotably coupled to the support plate 12*a*. One end 32*a* of the bending roller 32 is situated on the adhesive face 2*a*A of the adhesive tape 2*a*, and contacts and presses against the adhesive face except for part of a predetermined width W2 to be folded at one side of the adhesive tape 2*a*. That is, as shown in FIGS. 2 and 4A, a circumferential surface 32*b* of the bending roller 32 contacts the adhesive face 2*a*A of the adhesive tape 2*a* pulled out from the adhesive-tape roll 2 over not its entire width but a predetermined part without contacting part of a predetermined width w to be folded. Furthermore, multiple grooves are formed in the circumferential surface 32*b* to reduce the area contacting the adhesive face 2*a*A to prevent the adhesive tape 2*a* from sticking. The side edge of the adhesive tape 2*a* guided by the positioning roller 31 is bent with the end face 32*a* and guided toward the folding mechanism 20.

Moreover, the bending guide block 60 as a non-adhesive face-side member is provided on the inner face of one side plate 13*b* of the movable bracket 13 having a cross-section shaped like a squared U so as to be opposite the end face 32*a* of the bending roller 32 and to contact and press against the non-adhesive face of the side edge 2*a*S of the predetermined width W2, to sandwich the side edge 2*a*S between the end face 32*a* of the bending roller 32 and itself, and to bend part of the predetermined width W2 backward, in order to bend backward the side edge 2*a*S of the predetermined width W2 not contacting the bending roller 32. The bending guide block 60 extends farther toward the folding mechanism 20 than the circumferential surface of the bending roller 32 and has a guide protrusion 62 formed in a triangle shape at the end thereof which protrusion contacts the non-adhesive face of the side edge 2*a*S bent at about 90° of the adhesive tape 2*a* so as to guide and further bend the side edge 2*a*S to be at a bending angle of about 120°, that is, to form an acute angle of about 60° with the opposite adhesive face. Note that the guide protrusion 62 is not indispensable but can be omitted.

The folding mechanism 20, as shown in FIGS. 2, 3, 4A, is a folding guide block having a guide portion that contacts and presses against the non-adhesive face of the bent side edge 2*a*S of the adhesive tape 2*a* to bend the side edge 2*a*S to be at about 180°. In the present embodiment, this folding guide block comprises a sloping block 21 as a first guide portion to guide and bend the side edge 2*a*S of the adhesive tape 2*a* to be at a bending angle of about 135° (for the opposite adhesive faces to form an acute angle of about 45°) and a notched block 22 as a second guide portion placed adjacent to the sloping block 21 to guide and further bend such that the bending angle reaches about 180°, and both the blocks 21, 22 are fixed to the support plate 12*a* such that they are disposed on the side faced by the adhesive face below the adhesive tape 2*a* and in an almost middle between the tape holder 11 and the cutter blade 8.

That is, the sloping block 21 has a sloping surface 21*a* making an acute angle of $\alpha$ (≈45°) with the adhesive face 2*a*A of the adhesive tape 2*a* in the tape inserting chamber 15, and is fixed to the support plate 12*a*.

The notched block 22 has a wedge-like notch 23 having a slit-like exit 23*a* slightly larger than the thickness of the adhesive tape 2*a* and an insert entrance 23*b* larger than the slit-like exit 23*a*. The notched block 22 is divided into a top block 22*a* situated above the notch 23 in FIGS. 3, 4B and a base block 22*b* situated below; the top block 22*a* is fixed to the movable bracket 13; and the base block 22*b* integral with the sloping block 21 is fixed to the support plate 12*a*.

The sticking section 40 is for sticking together the opposite adhesive faces of the adhesive tape 2*a* having the side edge 2*a*S folded and is provided in between the folding mechanism 20 and the cutting section 6 as shown in FIGS. 2, 3. In this embodiment, the sticking section 40 is constituted by a rubber-made press roller 41, which contacts the non-adhesive face of the adhesive tape 2*a* having the side edge 2*a*S folded to press and stick the adhesive tape 2*a* at the adhesive face 2*a*A to an object. The press roller 41 is rotatably, pivotably coupled at both ends to the opposite side plates 13*b* of the movable bracket 13.

With the tape cutter 10, for example, in order to exchange adhesive-tape rolls 2, the movable bracket 13 as an open/close member is pivoted about the pivot pins 13*c* relative to the support plate 12*a* and side plate 12*b* of the body bracket 12 up to the position indicated by a chain line in FIG. 3 so that the inserting path for the adhesive tape 2*a* is exposed open. Accordingly, grooves 68 are made in the support plate 12*a* and side plate 12*b* of the body bracket 12 along the paths through which ends of the top block 22*a*, positioning roller 31, and press roller 41 coupled to the side plates 13*b* of the movable bracket 13 move, so as to prevent interference. Hence, by opening the movable bracket 13, the top block 22*a*, positioning roller 31, and press roller 41 as non-adhesive face-side members are moved in an arc away from the bending roller 32, sloping block 21, and base block 22*b* as adhesive face-side members. Thus, the loading of the adhesive tape 2*a* into the double-portion forming section 16 can be easily performed.

That is, the movable bracket 13 as the open/close member of the tape cutter 10 is configured to be movable between a closed position where the non-adhesive face-side members coupled to the movable bracket 13 contact and press against the adhesive tape 2*a* inserted through the tape inserting chamber 15 and an open position where the non-adhesive face-side members do not, and in the open position, the non-adhesive face-side members are apart from the adhesive face-side members such that a path for the adhesive tape to be inserted through is opened up.

Next, sticking the adhesive tape 2*a* with the tape cutter 10 will be described.

First, the movable bracket 13 is opened, and the adhesive-tape roll 2 is mounted on the tape holder 11 and housed in the tape housing section 7. Then, the leading end of the adhesive tape 2*a* is held with finger tips, and the adhesive tape 2*a* is pulled out from the adhesive-tape roll 2. The pulled-out adhesive tape 2*a* is inserted through the inserting path in between the non-adhesive face-side members and adhesive face-side members of the double-portion forming section 16 such that the leading end thereof is placed on the cutter blade 8, and the movable bracket 13 is closed.

Then, the leading end of the adhesive tape 2*a* is held with finger tips, and the adhesive tape 2*a* is further pulled out from the adhesive-tape roll 2, and thus tension acts on the pulled-out portion. As shown in FIG. 4A, the end 32*a* of the bending roller 32 is situated on the adhesive face 2*a*A of the adhesive tape 2*a*, and one longitudinal side edge of the pulled-out adhesive tape 2*a* is not in contact with the bending roller 32. Hence, while being bent in the direction that the adhesive face 2*a*A is facing along a longitudinal line on the adhesive tape 2*a* which the circumference of the end 32*a* of the bending roller 32 contacts, the side edge 2*a*S goes into between the end 32*a* and the bending guide block 60, where the side edge 2*a*S is bent at an angle of about 90°. Further, it is bent at an acute angle of about 60° by the guide protrusion 62.

As shown in FIG. 4B, the sloping surface 21*a* of the sloping block 21 is disposed to contact the non-adhesive face 2*a*B of the one side edge of the adhesive tape 2*a*, and the side edge of the adhesive tape 2*a* is bent at a further acute angle in the direction that the adhesive face 2*a*A is facing.

In the notched block 22, the adhesive tape 2*a* bent at the acute angle by the sloping block 21 is inserted through the insert entrance 23*b*, and as it goes through the notch 23, increasingly bent up to a degree that opposite adhesive face 2*a*A parts are almost parallel at the exit 23*a* slightly larger than the thickness of the adhesive tape 2*a*. Thereby, a continuous double-portion 50 with the adhesive face 2*a*A inside is formed at the one side edge of the adhesive tape 2*a* output from the exit 23*a*. This series of steps are consecutively performed by sequentially pulling out the adhesive tape 2*a* from the adhesive-tape roll 2.

The adhesive tape 2*a* is pulled out until its part having the double-portion 50 formed reaches the cutting section, and is cut by the cutter blade 8, and thereby the loading of the adhesive-tape roll 2 into the tape cutter 10 finishes.

The size of the double-portion 50 formed by the folding mechanism 20 is restricted by the bending roller 32 to a predetermined size W2. That is, part of the adhesive tape 2*a* farther than the end 32*a* and contacting the circumferential surface 32*b* of the bending roller 32 is not bent as shown in FIG. 4A, thus keeping the size of the double-portion 50 at the predetermined size W2 of the side edge 2*a*S, not contacting the bending roller 32, on the other side of the end 32*a*.

Moreover, the size W2 of the double-portion 50 restricted by the bending roller 32 varies depending on the width-direction position relationship between the adhesive tape 2*a* and the bending roller 32. Accordingly, in the tape cutter 10, the positioning roller 31, which guides the adhesive tape 2*a* to the bending roller 32, restricts variation in the width-direction position of the adhesive tape 2*a*. That is, although the tension occurring while the double-portion 50 is being formed attempts to move the side end of the adhesive tape 2*a* contacting the flange 31*b* of the positioning roller 31 toward the double-portion 50, i.e., to the upper right in FIG. 4A, the side end of the adhesive tape 2*a* is restricted in movement by contacting the flange 31*b* of the positioning roller 31. Thus, the width-direction position of the adhesive tape 2*a* is always kept constant.

When sticking the adhesive tape 2*a* to an object such as a cardboard box, while gripping the grip of the tape cutter 10 formed by the tape holder 11 and the tap cover 14 with one hand and pressing the leading end of the adhesive tape 2*a* by the press roller 41 against a target object, a worker moves the tape cutter 10 along a desired line so that the adhesive tape 2*a* being pulled out from the adhesive-tape roll 2 is stuck along the line. At this time, the tap cover 14 gripped by the hand contacts and presses against the circumferential surface of the adhesive-tape roll 2, and this pressing force acts as a brake on the rotation of the adhesive-tape roll 2 thereby causing appropriate tension to act on the adhesive tape 2*a* pulled out from the adhesive-tape roll 2. This tension operates such that the bending roller 32 smoothly bends the adhesive tape 2*a*.

Hence, while the side edge 2*a*S of the adhesive tape 2*a* is being folded back with opposite adhesive faces being pressed against each other to reliably form the non-adhesive portion, the double portion 50, at the side of the adhesive tape 2*a*, the adhesive tape 2*a* is stuck to an object. After the adhesive tape 2*a* is pulled out so as to be stuck over a desired length to the lids of a cardboard box or the like, the adhesive tape 2*a* is cut by being pressed against the cutter blade 8 of the tape cutter 10.

In this way, by using the tape cutter 10, while the non-adhesive portion, the double portion 50, is being continuously formed at the side of the adhesive tape 2*a* along the longitudinal direction, the adhesive tape 2*a* can be stuck. Thereafter, when opened, the adhesive tape can be easily picked off holding the double portion 50 as a picking-off portion.

SECOND EMBODIMENT

Figure 5:
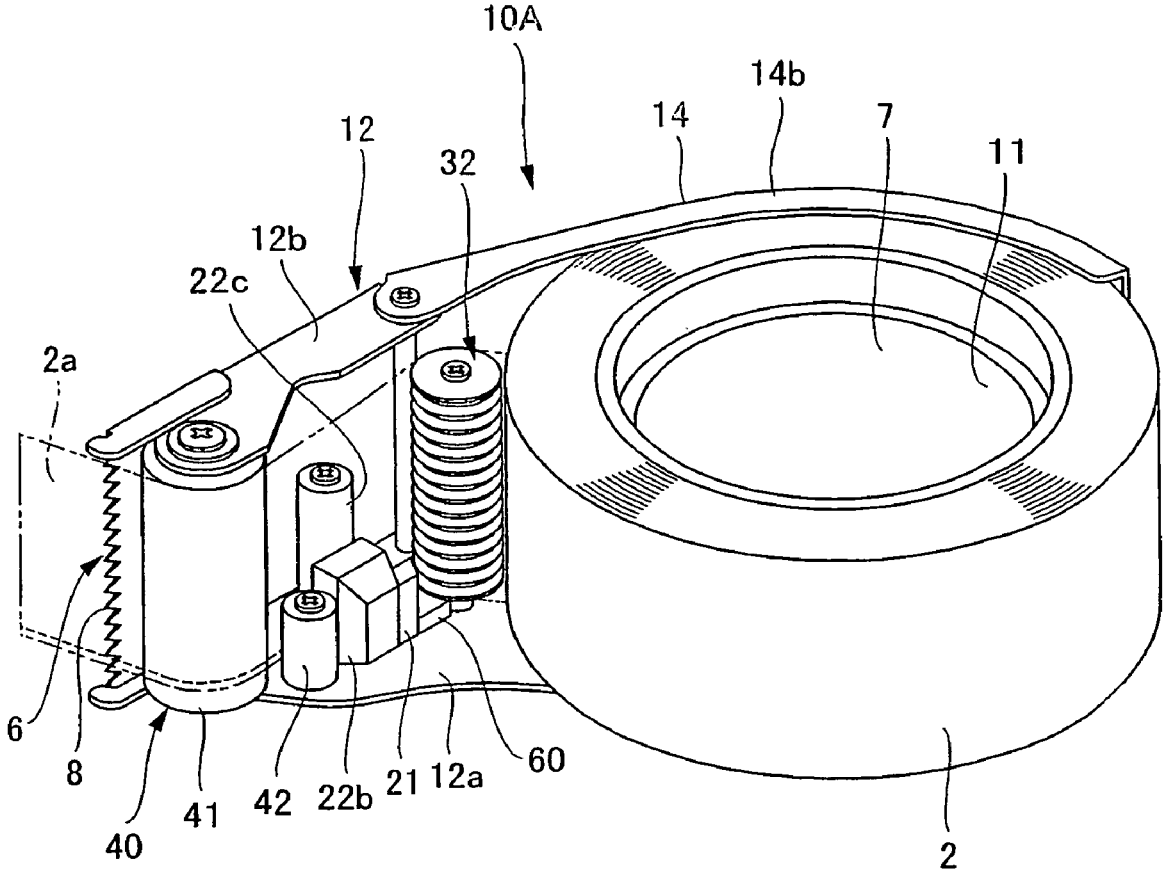
FIG. 5 is a perspective view illustrating an adhesive tape cutter according to a second embodiment of the present invention.
Figure 6:
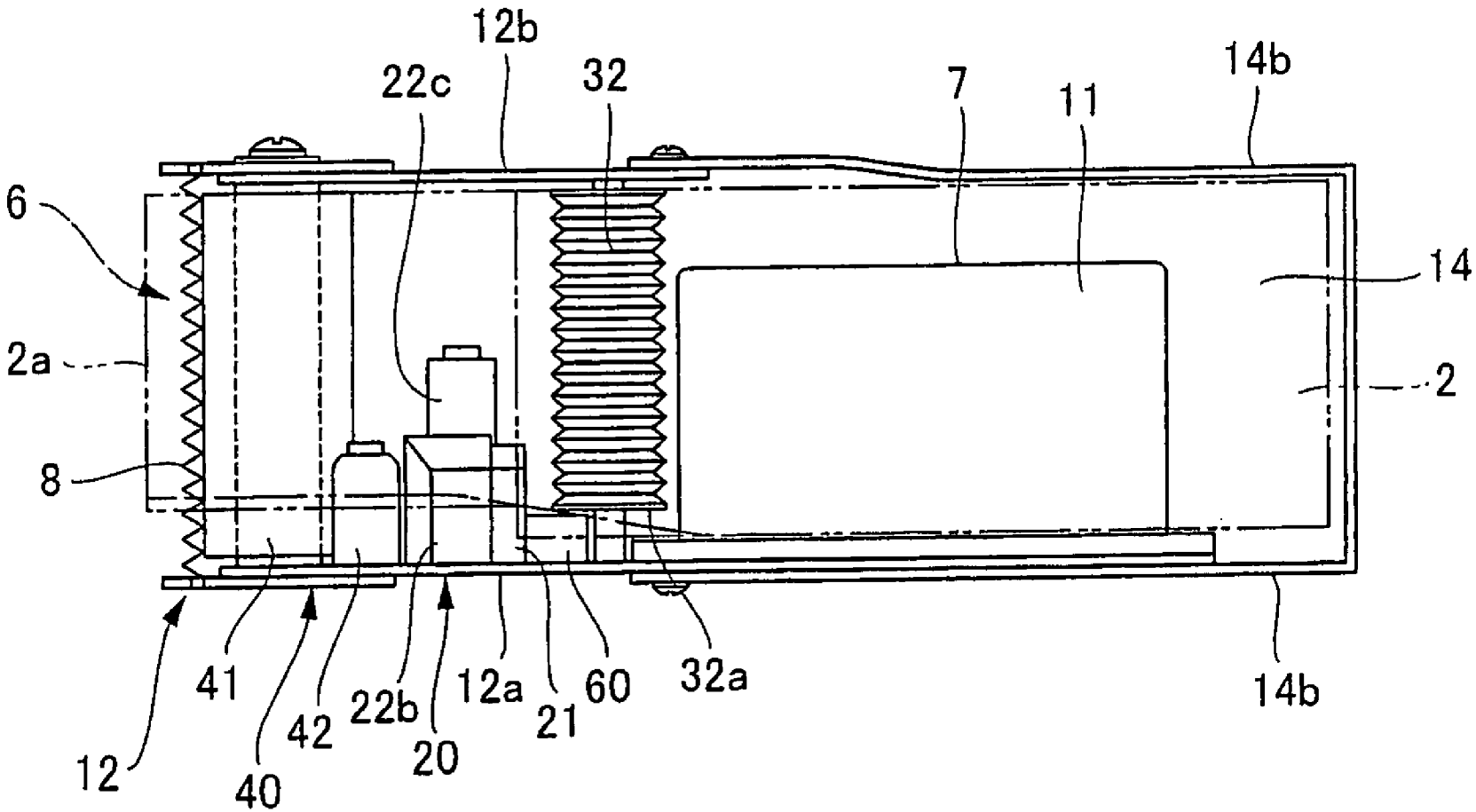
FIG. 6 is a bottom view of the tape cutter of FIG. 5.
Figure 7:
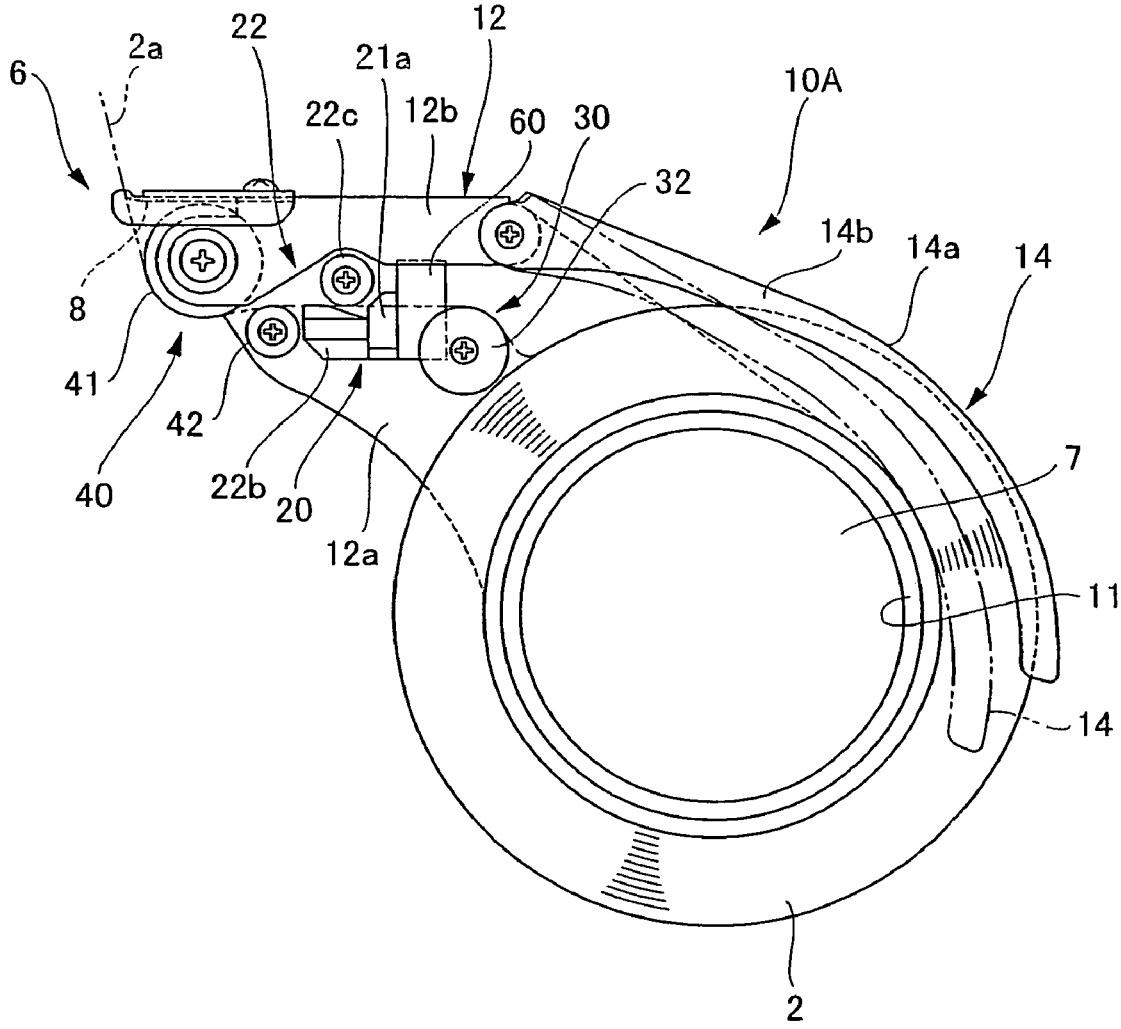
FIG. 7 is a side view of the tape cutter of FIG. 5.
Figure 8:
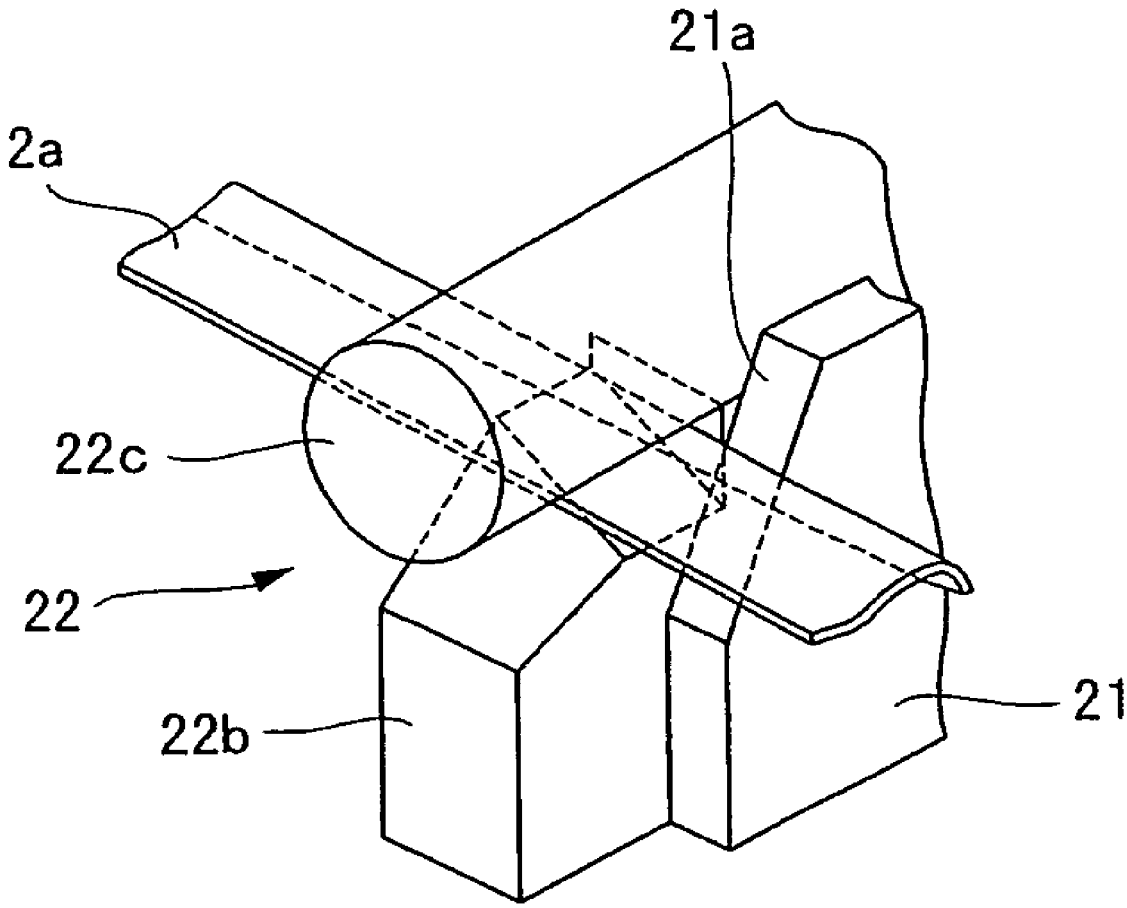
FIG. 8 is an enlarged perspective view of a folding mechanism of FIG. 5.

FIGS. 5 to 8 show a second embodiment of the adhesive tape cutter according to the present invention; FIG. 5 is a perspective view thereof; FIG. 6 is a bottom view; FIG. 7 is a side view; and FIG. 8 is an enlarged perspective view of a folding mechanism. In the second embodiment, the essential configuration thereof is the same as in the first embodiment, and the same reference numerals indicate the same or like parts as in the first embodiment, and a description thereof is omitted.

The tape cutter 10A of the second embodiment also has a body bracket 12 provided at its one end with a support 11 that rotatably supports the adhesive-tape roll 2 and at the other end with a cutting section 6 to cut the adhesive tape 2*a* pulled out from the adhesive-tape roll 2 supported by the support 11.

In the second embodiment, the movable bracket 13 is not provided, and the cutting section 6 provided at the leading end of the body bracket 12 is comprised of a press roller 41 pivotably coupled at its opposite ends to a support plate 12*a* and to a side plate 12*b* of an L-shaped portion extending laterally from the support plate 12*a* and formed integrally therewith, and a cutter blade 8 fixed to the leading end of a top plate 12*c* between the support plate 12*a* and the side plate 12*b* and over the press roller 41.

Provided in the path to pull out the adhesive tape 2*a* through from the support 11 to the cutting section 6 is a double-portion forming section 16 supported by the body bracket 12. The double-portion forming section 16, as in the first embodiment, comprises adhesive face-side members disposed on a side faced by the adhesive face of the adhesive tape 2*a* and non-adhesive face-side members disposed on a side faced by a non-adhesive face thereof. The adhesive tape 2*a* is inserted through between the adhesive face-side members and the non-adhesive face-side members, and when the adhesive tape 2*a* is pulled out, both the members contact and press against the adhesive tape 2*a* and fold a side edge 2*a*S of a predetermined width W2 in a direction that the adhesive face 2*a*A is facing to form the double portion 50 as a non-adhesive portion along the longitudinal direction.

The double-portion forming section 16 comprises a bending mechanism 30, a folding mechanism 20, and a sticking section 40. The bending mechanism 30 comprises a bending roller 32 as an adhesive face-side member that contacts the adhesive face 2*a*A except the side edge of the predetermined width W2 to be bent and a bending guide block 60 placed opposite an end face 32*a* of the bending roller 32. The bending roller 32 is pivotably coupled at one end to the support plate 12*a*, and the bending guide block 60 is fixed to the inner surface of the support plate 12*a*. The bending guide block 60 contacts and presses against the non-adhesive face of the side edge 2*a*S not contacting the bending roller 32, to sandwich the side edge 2*a*S between the end face 32*a* of the bending roller 32 and itself and bend the side edge 2*a*S of the predetermined width W2 backward as in the first embodiment.

The folding mechanism 20 is essentially the same as in the first embodiment, but a press roller 22*c* is provided instead of the top block 22*a* of the first embodiment. That is, the side edge 2*a*S of the adhesive tape 2*a* contacts and presses at the non-adhesive side against the sloping block 21 (a first guide) as the folding guide block of the folding mechanism 20 to be bent at an acute angle of about 45° to the opposite adhesive face, and then contacts and presses against a base block 22*b* (a second guide portion) to be further bent at about 180°. This base block 22*b* has a wedge-shaped notched portion on its top, and immediately above the notched portion, the press roller 22*c* is coupled at one end to the support plate 12*a* so as to be placed adjacent to the sloping block 21. Further, the base block 22*b* integral with the sloping block 21 is fixed to the support plate 12*a*.

As such, the press roller 22*c* is provided instead of the top block 22*a* and the adhesive tape 2*a* is pressed against the press roller 22*c*. Hence, with reduced tension acting on the adhesive tape 2*a*, the side edge 2*a*S can be folded smoothly, reliably. Thus, with reduced operation force in pulling-out, operability can be improved as much as possible. Here, if the winding angle of the adhesive tape 2*a* winding around the press roller 22*c* is set slightly larger thereby setting pressing force of the adhesive tape 2*a* slightly larger, the opposite adhesive faces of the adhesive tape 2*a* can be stuck together by the press roller 22*c*.

The sticking section 40 comprises the press roller 41 and a guide roller 42 upstream thereof. The guide roller 42 is placed on the side faced by the adhesive face and supported at one end by the support plate 12*a*, and has a length so short as to contact and just cover the double portion 50 of the width W2, so that it engages with the double portion 50 of the adhesive tape 2*a* near its leading end. Furthermore, the press roller 22*c* has a length that is enough to contact and cover the double portion 50 of the width W2 and so short that the adhesive tape 2*a* is easy to insert and load. Also, the support plate 12*a* of the body bracket 12 covers the adhesive tape 2*a* and the inserting path from only one side with the other side left open, from which side the adhesive tape 2*a* is easy to load into the inserting path.

Moreover, a tape cover 14 is provided outside the support 11 constituted by a cylinder and pivotably coupled to the rear end of the top plate 12*c* of the body bracket 12. The tape cover 14 covers at least part of the adhesive-tape roll 2 supported by the support 11, always contacts the circumferential surface of the adhesive-tape roll 2, following the change in the diameter of the adhesive-tape roll 2, and forms a grip together with the support 11.

With the tape cutter 10A of the second embodiment configured in this way, while the non-adhesive portion, the double portion 50, is being easily, continuously formed at one side edge of the adhesive tape 2*a* along the longitudinal direction, the adhesive tape 2*a* can be stuck as with the tape cutter 10 of the first embodiment. Thereafter, when opened, the adhesive tape can be easily picked off holding the double portion 50 as a picking-off portion, which is the same effect as with the tape cutter 10.

The above embodiments are provided to facilitate the understanding of the present invention and not intended to limit the present invention. It should be understood that various changes and alterations can be made therein without departing from the spirit and scope of the invention and that the present invention includes its equivalents.

INDUSTRIAL APPLICABILITY

As described in detail by way of the embodiments of the present invention, with the adhesive tape cutter of the invention, a non-adhesive portion as a picking-off portion for facilitating removal of an adhesive tape after the adhesive tape is stuck to an object can be easily, continuously formed along the longitudinal direction by folding its side edge and sticking, while pulling out adhesive tape. Furthermore, while forming the non-adhesive portion, the adhesive tape can be easily stuck to an object with one hand.

The invention claimed is:

1. An adhesive tape cutter comprising:

a body bracket provided at its one end with a support that rotatably supports an adhesive-tape roll and at the other end with a cutting section to cut adhesive tape pulled out from the adhesive-tape roll supported by the support, wherein provided in a path to pull out the adhesive tape through from the support to the cutting section in the body bracket is a double-portion forming section that includes adhesive face-side members disposed on a side faced by an adhesive face of the adhesive tape and non-adhesive face-side members disposed on a side faced by a non-adhesive face thereof and that, after the adhesive tape is inserted through between the adhesive face-side members and the non-adhesive face-side members, folds at least one side edge of a predetermined width of the adhesive tape in a direction that the adhesive face is facing to form a double portion as a non-adhesive portion along its longitudinal direction when the adhesive tape is pulled out, and wherein a tape cover is provided outside the support and pivotably coupled to the body bracket so as to cover at least part of the adhesive-tape roll supported by the support, to contact an outer circumferential surface of the adhesive-tape roll and form part of a grip, wherein the double-portion forming section comprises a bending roller as one of the adhesive face-side members that contacts the adhesive face of the adhesive tape except the side edge of the predetermined width to be bent;

a bending guide block as one of the non-adhesive face-side members that is placed opposite an end face of the bending roller and contacts and presses against the non-adhesive face of the side edge of the adhesive tape, not contacting the bending roller, to sandwich the side edge between the end face of the bending roller and itself and bend the side edge of the predetermined width in the direction that the adhesive face is facing;

a folding guide block as one of the adhesive face-side members that has a guide portion contacting and pressing against the non-adhesive face of the bent side edge to bend the side edge to be at an acute angle and that is placed on the side faced by the adhesive face of the adhesive tape; and a press roller that contacts and presses against the non-adhesive face of the adhesive tape having the side edge folded to stick together opposite adhesive faces of the folded adhesive tape;

wherein the bending guide block has an extending end portion which extends further toward the folding guide block side than the circumferential surface of the bending roller; and wherein the extending end portion has a guide protrusion, the guide protrusion guiding and further bending the side edge to be at a bending angle of an acute angle with the opposite adhesive face by contacting the non-adhesive face of the side edge that is bent.

* * * * *